US012121122B2

(12) United States Patent
Patel et al.

(10) Patent No.: US 12,121,122 B2
(45) Date of Patent: Oct. 22, 2024

(54) UMBRELLA CASE

(71) Applicants: Sanjay Patel, Thornton Heath (GB); Rachel Grimaldi, Thornton Heath (GB)

(72) Inventors: Sanjay Patel, Thornton Heath (GB); Rachel Grimaldi, Thornton Heath (GB)

( * ) Notice: Subject to any disclaimer, the term of this patent is extended or adjusted under 35 U.S.C. 154(b) by 0 days.

(21) Appl. No.: 17/768,849

(22) PCT Filed: Sep. 8, 2020

(86) PCT No.: PCT/GB2020/052151
§ 371 (c)(1),
(2) Date: Apr. 13, 2022

(87) PCT Pub. No.: WO2021/074561
PCT Pub. Date: Apr. 22, 2021

(65) Prior Publication Data

US 2024/0130492 A1 Apr. 25, 2024
US 2024/0225216 A9 Jul. 11, 2024

(30) Foreign Application Priority Data

Oct. 18, 2019 (GB) ..... 1915160

(51) Int. Cl.
*A45B 25/24* (2006.01)
*A45F 3/02* (2006.01)
*A45F 3/00* (2006.01)

(52) U.S. Cl.
CPC ..... *A45B 25/24* (2013.01); *A45F 3/02* (2013.01); *A45F 2003/003* (2013.01); *A45F 2200/0566* (2013.01)

(58) Field of Classification Search
CPC ..... A45B 25/24; A45F 2200/0566; A45F 2003/003; A45F 3/02
(Continued)

(56) References Cited

U.S. PATENT DOCUMENTS 3,526,238 A * 9/1970 Brayton ..... B60R 7/12 211/63
4,261,494 A * 4/1981 Thomas ..... A45F 5/00 224/614
4,558,807 A 12/1985 Jackson
D393,742 S * 4/1998 El-Edwy ..... D3/290
(Continued)

FOREIGN PATENT DOCUMENTS

DE 3524855 A1 12/1985
FR 460558 A 12/1913
(Continued)

OTHER PUBLICATIONS

Examination Report issued in IN Patent Application IN202217017139 on Aug. 11, 2022, 5 pages.
(Continued)

*Primary Examiner* — Justin M Larson
(74) *Attorney, Agent, or Firm* — Rivka Friedman

(57) ABSTRACT

An umbrella case configured to hold an umbrella having a rigid shaft with a handle at one end and a spike at the other end, the umbrella case comprising an umbrella holding assembly comprising a generally tubular sheath 106 having an open end and a spike-receiving portion 107 defining a spike-receiving aperture at the other end, and a fastening strap 100 having a first end coupled to an outer surface of the umbrella case, close to the open end of the sheath 106, and having a second, free end configured to be selectively moved to a fastening position in which it is connected to the umbrella case at a generally diametrically opposite location to the first end, the sheath, the spike-receiving portion and the fastening strap when in the fastening position, together, defining the effective length of the umbrella holding assembly, wherein at least one of the sheath, the spike-receiving portion and the fastening strap is selectively longitudinally extendible upon application of a force, in use, thereby to
(Continued)

SECTION D-D increase the effective length of the umbrella holding assembly to accommodate the length of an umbrella held therein.

9 Claims, 6 Drawing Sheets

(58) Field of Classification Search
USPC ..... 224/915
See application file for complete search history.

(56) References Cited

U.S. PATENT DOCUMENTS

| | | | | | |
|---|---|---|---|---|---|
| 6,015,077 | A | | 1/2000 | Disher | |
| D450,919 | S | * | 11/2001 | Lee | D3/11 |
| 6,655,399 | B1 | * | 12/2003 | Williams | A45B 25/24 135/34.2 |
| D692,651 | S | * | 11/2013 | Chin | A45C 13/40 D3/11 |

FOREIGN PATENT DOCUMENTS

| | | | | | |
|---|---|---|---|---|---|
| JP | H1057129 | A | | 3/1998 | |
| JP | 2000300322 | A | | 10/2000 | |
| KR | 20130025518 | A | * | 3/2013 | A45B 25/24 |
| KR | 20150001637 | U | * | 4/2015 | A45B 25/24 |
| WO | WO-2006098598 | A1 | * | 9/2006 | A45B 25/24 |
| WO | 2008062497 | A1 | | 5/2008 | |

OTHER PUBLICATIONS

International Search Report and Written Opinion mailed in International Patent Application PCT/GB2020/052151 on Oct. 26, 2020, 9 pages.

International Preliminary Report on Patentability and Written Opinion issued in International Patent Application PCT/GB2020/052151 on Apr. 19, 2022, 6 pages.

* cited by examiner

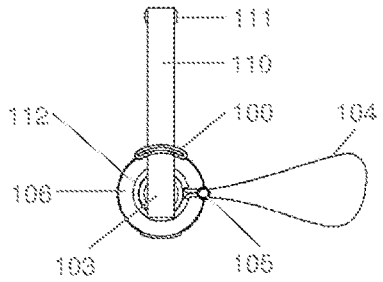
Fig. 2A
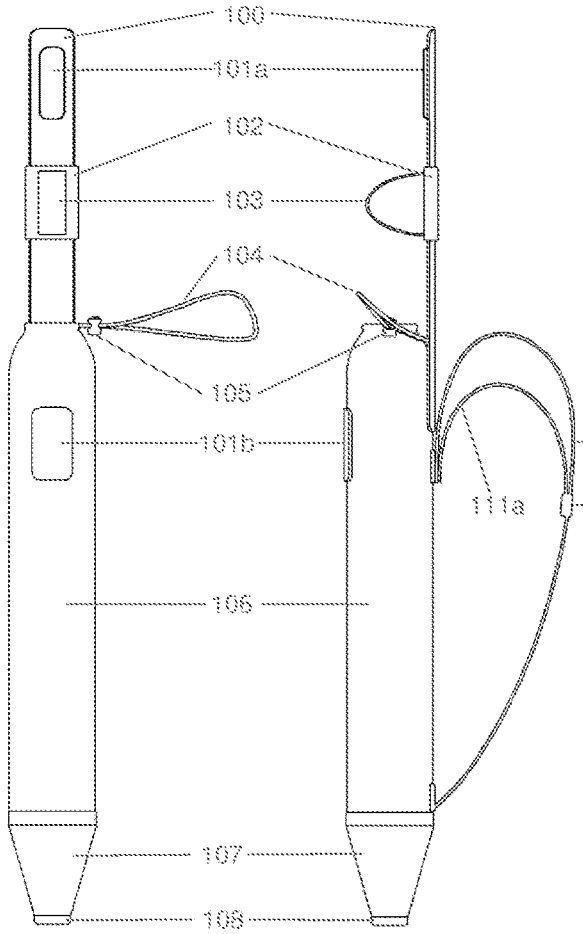
Fig. 1B
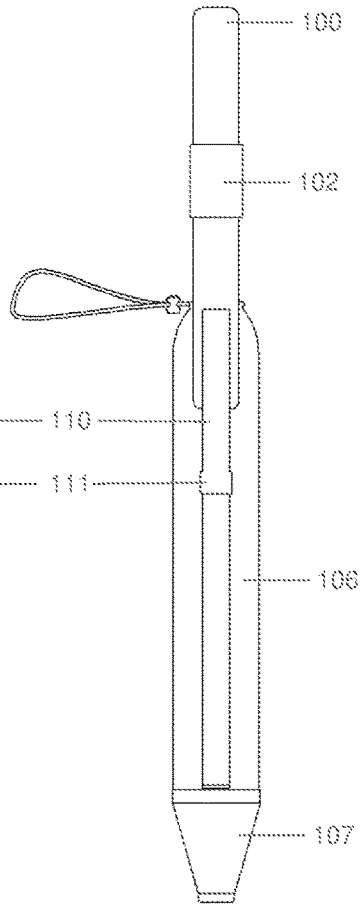
Fig. 1A
Fig. 2
Fig. 2B
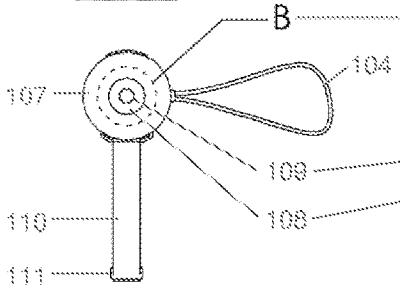
Fig. 2C
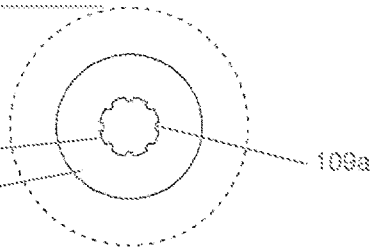

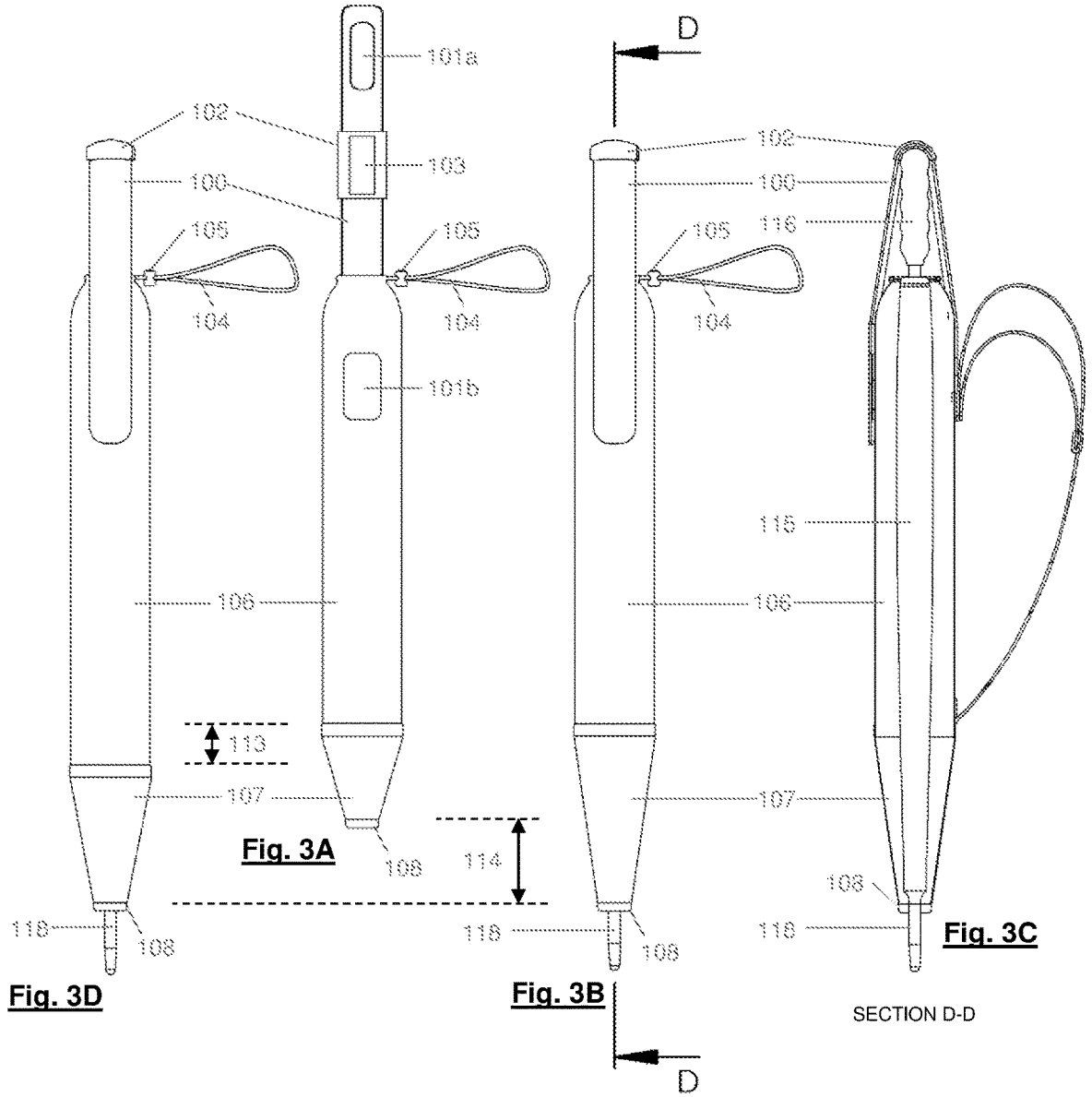
Fig. 3A
Fig. 3B
Fig. 3C
Fig. 3D
Fig. 3E
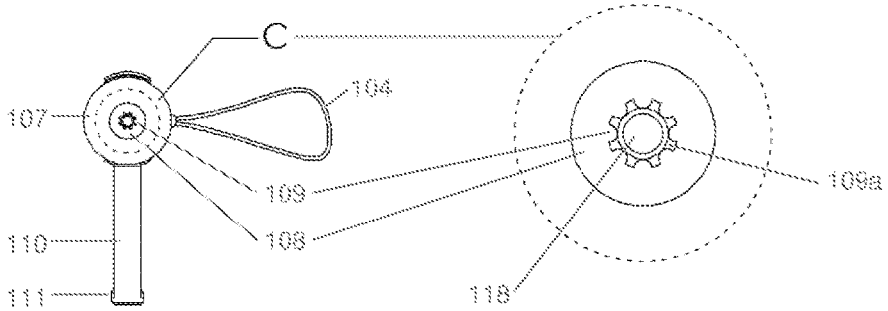
Fig. 3F

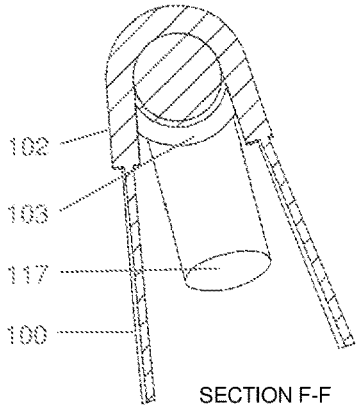
Fig. 4D
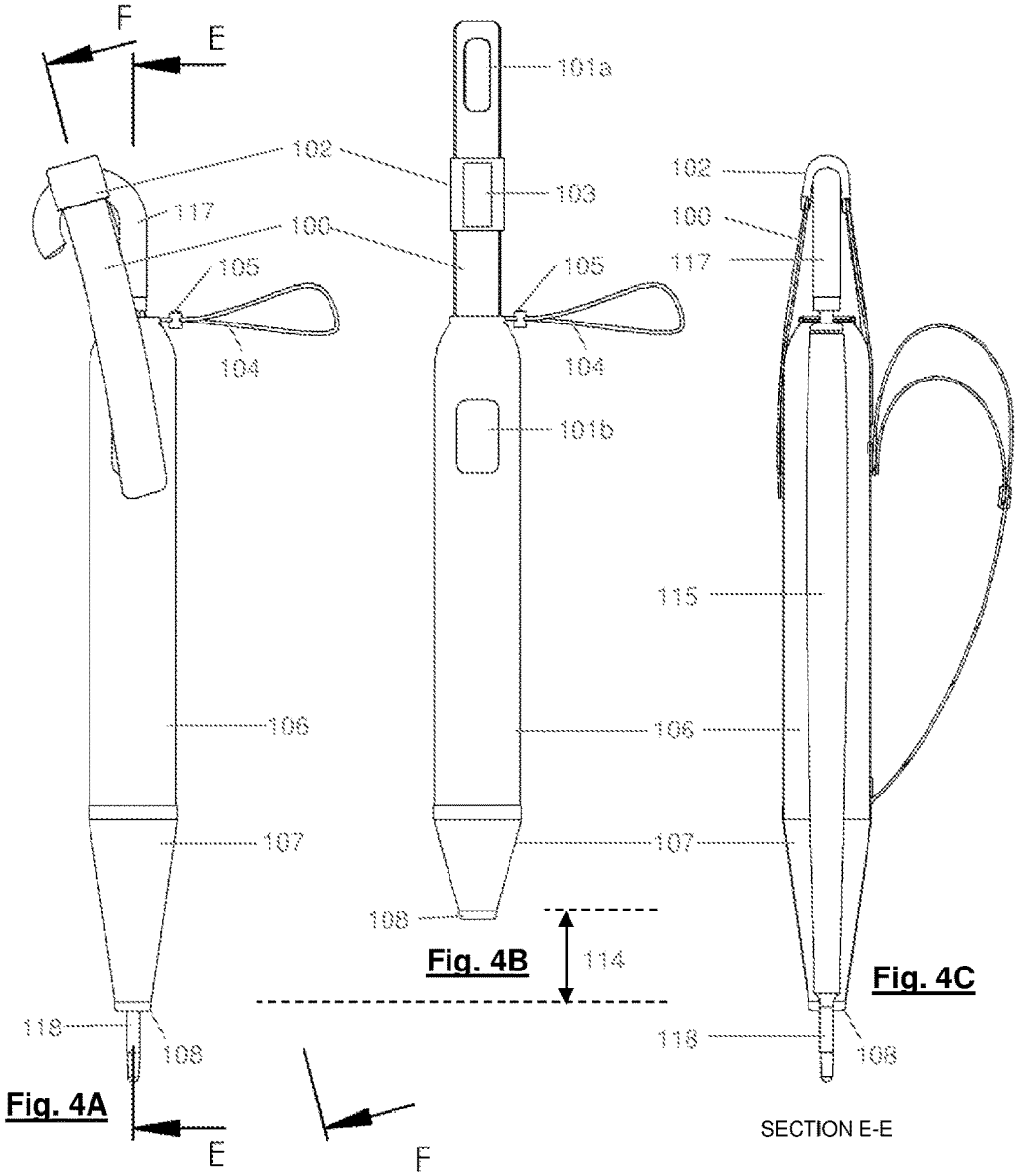
Fig. 4A
Fig. 4B
Fig. 4C

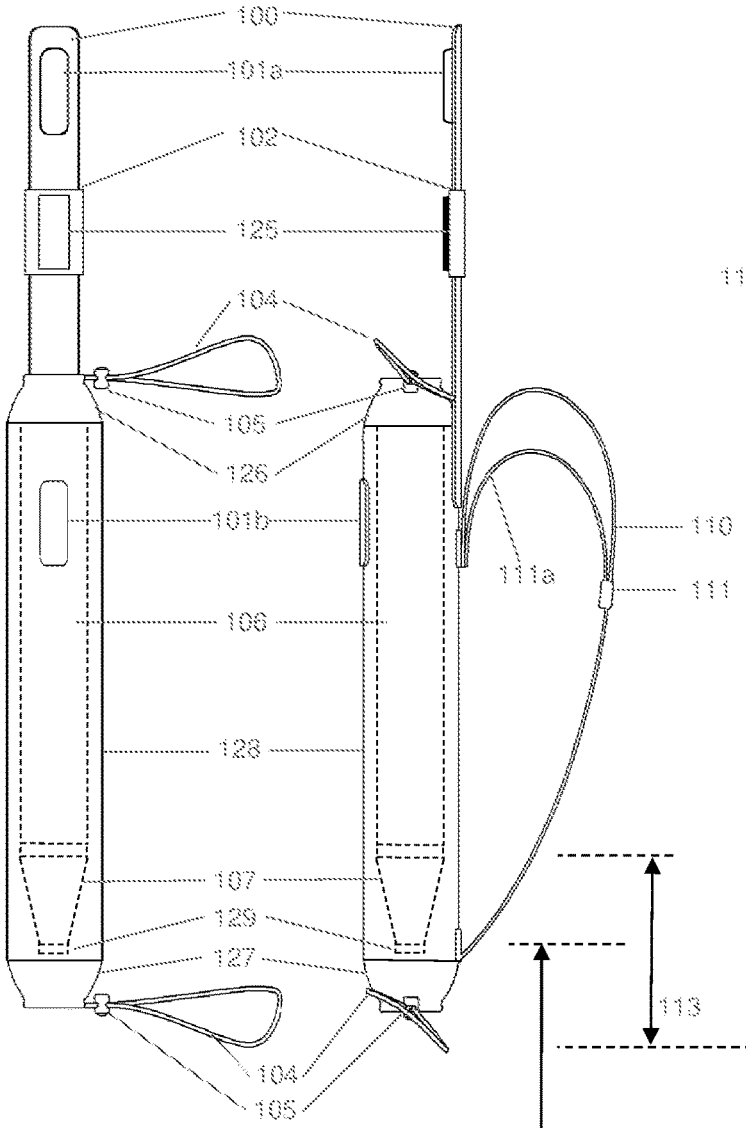
Fig. 7A
Fig. 7B
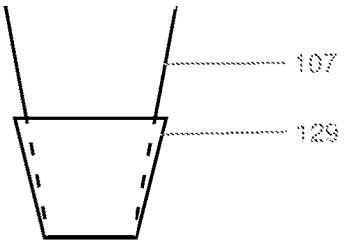
Fig. 7C
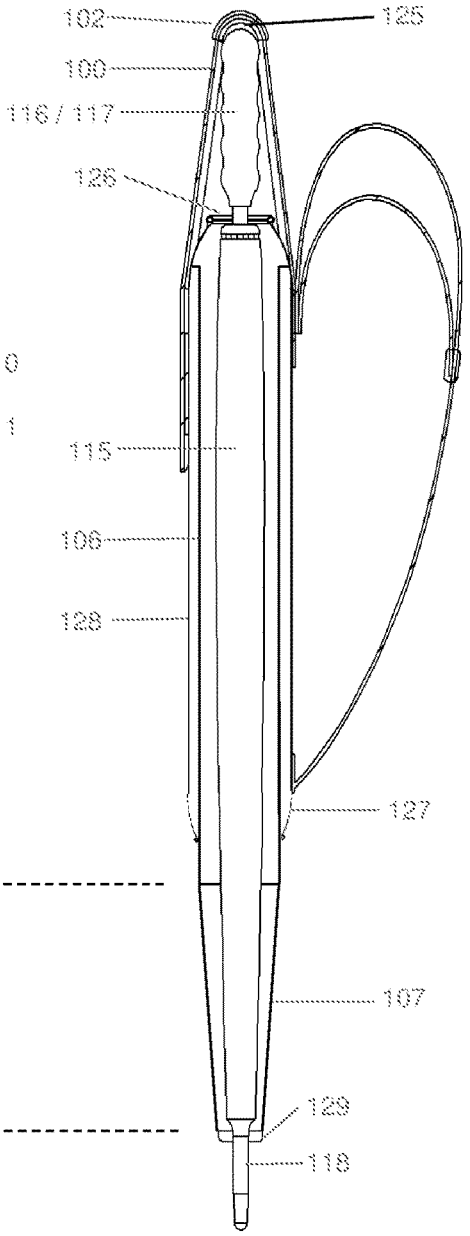
CROSS SECTION
of Fig. 7B with 115-118 inserted
and respective stretches
113 of 106 and 114 of 107
Fig. 7D

UMBRELLA CASE

The present invention relates to an umbrella case. Specifically, but not necessarily exclusively, the invention relates to an umbrella case suitable for holding long/stick umbrellas, which have a fixed length shaft and spokes, of different lengths, sizes and handle structures.

BACKGROUND TO THE INVENTION

Umbrellas are well known, and widely used to protect users from the elements, particularly but not exclusively, rain, hail or snow.

Personal umbrellas come in many shapes and sizes, ranging from smaller fold-down umbrellas having articulated spokes and telescopic shafts which enable the umbrella to fit into a small bag when not in use, to large umbrellas which have a fixed length shaft and spokes.

It is commonly known in the art to use an elongate bag or case to carry an umbrella when the umbrella is not in use. Where the umbrella has been used to protect the user from rain, hail or snow, an umbrella case advantageously allows the user to conveniently store the umbrella without any water runoff transferring to clothing or inside a hand bag or briefcase.

Such cases are specifically designed for the umbrella with which they are to be sold, and are designed to fit tightly around the collapsed umbrella without leaving much room around the umbrella itself. In general, in relation to long/stick umbrellas, a cover is often not provided at all, but even if a cover is provided it is designed specifically for that umbrella and may not accommodate an umbrella of a different fixed length.

Furthermore, umbrella cases known in the art require the user to use at least one hand to carry the encased umbrella at all times, or supply an additional means to carry it (for example a strap or suitable bag) if they want to keep their hands free.

An umbrella case according to the invention is intended to address at least one or more of the above-mentioned issues.

STATEMENTS OF INVENTION

In accordance with the present invention, there is provided an umbrella case configured to hold an umbrella having a rigid shaft with a handle at one end and a spike at the other end, the umbrella case comprising an umbrella holding assembly comprising a generally tubular sheath having an open end and a spike-receiving portion defining a spike-receiving aperture at the other end, and a fastening strap having a first end coupled to an outer surface of the umbrella case, close to the open end of the sheath, and having a second, free end configured to be selectively moved to a fastening position in which it is connected to the umbrella case at a generally diametrically opposite location to the first end, the sheath, the spike-receiving portion and the fastening strap when in the fastening position, together, defining the effective length of the umbrella holding assembly, wherein at least one of the sheath, the spike-receiving portion and the fastening strap is selectively longitudinally extendible upon application of a force, in use, thereby to increase the effective length of the umbrella holding assembly to accommodate the length of an umbrella held therein.

In an exemplary embodiment, the fastening strap may be coupled at one end to the sheath, close to its open end, and the other free end being configured to be selectively moved to a fastening position in which it is connected to the sheath at a generally diametrically opposite location to the first end.

In another exemplary embodiment, the umbrella case may further comprise a waterproof housing surrounding the sheath. In this case, the fastening strap may be coupled at a first end to the housing, close to the open end of the sheath, and the free end being configured to be selectively moved to a fastening position in which it is connected to the housing at a generally diametrically opposite location to the first end.

Optionally, the spike-receiving portion and/or the sheath is formed of an elastic material configured to be elastically stretched upon application of a longitudinal force.

The sheath and/or the spike-receiving portion may be formed of a waterproof or semi-permeable material, and the spike receiving portion may include at least one opening configured to allow water to drain out through it, when in use.

In an exemplary embodiment, the fastening strap comprises a strip of elastic material, connected at one end to the outer surface of the sheath, close to the open end, and having a first connecting portion at the other end. Optionally, the fastening strap further comprises a retaining member, slidably mounted thereon, said retaining member configured to be placed, in use, over the handle of an umbrella held in said umbrella case. The retaining member my further comprise a support loop extending from an inner and/or outer side edge thereof.

The spike-receiving portion may, optionally, comprise a generally conical portion configured to be selectively longitudinally extended upon application of a force, said generally conical portion comprising a base connected to, or formed integrally with, the sheath, and a frustrum defining said spike-receiving aperture. In this case, a rigid or semi-rigid ring may be mounted around said spike-receiving aperture. In an exemplary embodiment, the inner surface of the ring may be provided with ridges defining the maximum diameter of the spike-receiving aperture, and interposing grooves or notches.

Optionally, the fastening strap may be pivotally connected at its first end to the outer surface of the sheath.

The umbrella case may further comprise adjustment means, coupled to the open end of the sheath, and operable to selectively increase and decrease the diameter or width of said open end.

In an exemplary embodiment, the umbrella case may further comprise a carrying strap coupled to the outer surface of the sheath, the length of which may be selectively adjustable.

BRIEF DESCRIPTION OF THE DRAWINGS

Embodiments of the invention will now be described by reference to specific examples as illustrated in the accompanying drawings, in which:

FIG. 1A is a schematic side view of an umbrella case, according to the invention;

FIG. 1B is a schematic front view of the umbrella case of FIG. 1A;

FIG. 2 is a schematic rear view of the umbrella case of FIG. 1A;

FIG. 2B is a schematic bottom end view of the umbrella case of FIG. 1A;

FIG. 2C is an enlarged view of the portion of the umbrella case indicated by B in FIG. 2B;

FIG. 2A is a schematic top view of the umbrella case of FIG. 1A.

FIG. 3A is a schematic front view of an umbrella case according to an exemplary embodiment of the invention;

FIG. 3B is a schematic front view of the umbrella case of FIG. 3A when in use carrying a long stick, straight handled umbrella;

FIG. 3C is a schematic cross-sectional view through the line D-D of FIG. 3B;

FIG. 3D is a schematic front view of an umbrella case according to another exemplary embodiment of the invention when in use carrying a long stick, straight handled umbrella;

FIG. 3E is a bottom end view of the umbrella case of FIG. 3B or 3D;

FIG. 3F is an enlarged view of the portion of the umbrella case indicated by B in FIG. 3E;

FIG. 4B is a schematic front view of an umbrella case according to an exemplary embodiment of the invention;

FIG. 4A is a schematic front view of the umbrella case of FIG. 4B when in use carrying a long stick, hooked handled umbrella;

FIG. 4C is a schematic cross-sectional view through the line E-E in FIG. 4A;

FIG. 4D is a schematic cross-sectional view through the line F-F in FIG. 4A;

FIG. 7A is a schematic front view of an umbrella case according to an exemplary embodiment of the invention;

FIG. 7B is a schematic side view of the umbrella case of FIG. 7A, in the open configuration;

FIG. 7C is a schematic enlarged side view of the bottom portion of the sheath of the umbrella case of FIGS. 7A and 7B; and FIG. 7D is a schematic side cross-sectional view of the umbrella case of FIGS. 7A and 7B when in use carrying a long stick umbrella.

DETAILED DESCRIPTION

Figure 3G:
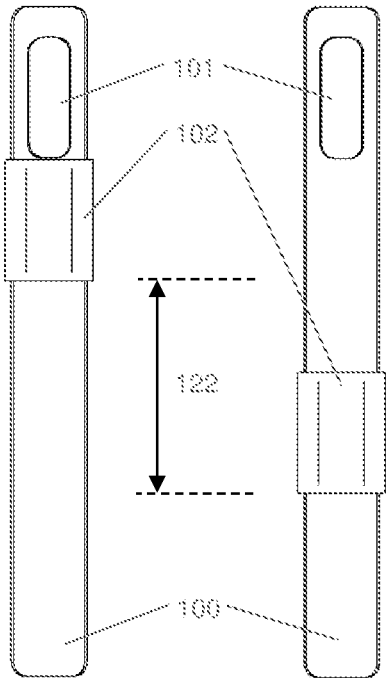
FIG. 3G illustrates schematically the retaining member and fastening strap of the umbrella case of FIG. 1A.

Referring to FIGS. 1A, 1B and 2 of the drawings, an umbrella case according to an exemplary embodiment of the present invention comprises a generally tubular sheath 106, which is shown as having a substantially circular cross-sectional shape but could be of any desired cross-sectional shape and the present invention is not necessarily intended to be limited in this regard. The sheath 106 may be formed of a rigid, semi-rigid or flexible and/or elastic material. In one embodiment, the sheath 106 is (at least) longitudinally extendible, by virtue of the elasticity of the material of which it is formed and/or a telescopic construction which may include a lock or retaining means for retaining the sheath in one of a number of possible longitudinal configurations (lengths). The sheath 106 may, of course, be formed of a 'stretchy' elastic material that allows it to be extended in both the longitudinal and the diametric directions by application of an appropriate force.

In the example shown, the sheath 106 is formed of a flexible material, beneficially tearproof, waterproof and/or quick-dry properties (which may or may not be elastically deformable, at least longitudinally, as referenced above). The sheath 106 may be of any suitable length and cross-sectional diameter, depending largely on the material used (whether elastic or not, for example) to enable the umbrella-receiving cavity it defines to be adapted to receive long-stick umbrellas of varying sizes.

An adjustable closure means 104, 105 may be provided at an open end of the sheath 106, and configured to selectively allow the open end of the sheath 106 to be extended to its maximum cross-sectional diameter (for receiving or removing an umbrella), partially closed (around the shaft of an umbrella), or fully closed (for storage). Referring additionally to FIG. 2A of the drawings, the adjustable closure means is illustrated in the form of a draw string 104 comprising a loop through a seam 112 at the open end of the sheath 106, that can be pulled to tighten or close the open end and released, e.g. manually or elastically, depending on the material used to form the loop) to extend the open end to receive or remove an umbrella. For example, the loop may be formed of cord or elastic. An adjuster 105 is provided around the loop to provide a secure/release mechanism for selectively securing and releasing the draw string, as required.

At the end of the sheath 106 longitudinally opposite the open end, there is provided a spike-receiving portion 107 configured to accommodate the spike of a long-stick umbrella. In the example illustrated, the spike-receiving portion 107 comprises a conical member having a base of shape and diameter (or width) substantially the same as that of the sheath 106, and affixed thereto, and a frustrum defined by a ring 108 providing a hole through which a spike of an umbrella may extend, in use. The ring 108 may be formed of any suitable rigid or semi-rigid material. Referring additionally to FIGS. 2B and 2C of the drawings, the inner circumference of the ring 108 defines a spike-receiving opening or hole having a plurality of ridges 109*a*. The ridges 109*a* are beneficial in that, in use, they act to create gaps between the base of the umbrella spike (or the 'top cap' of the umbrella) and the ring 108 and thereby allow water from the umbrella to drain out from the spike-receiving portion 107 and also out through the ridged gaps.

In the embodiment shown, the spike-receiving portion 107 is a separate member to the sheath 106 and connected or affixed thereto at the base. However, in alternative embodiments, the spike-receiving portion may be integrally formed with the sheath 106 (i.e. of the same material) such that it is defined by a closed ('lower') end of the sheath 106 with a spike-receiving opening therein. The spike-receiving portion could, in this case, be defined by a tapered 'lower' section of the sheath, having a gradually reducing diameter, for example, and terminating at the spike-receiving opening. The ridged ring could be affixed around the spike-receiving opening, as in the exemplary embodiment illustrated and described above.

In the case where the spike-receiving portion 107 is affixed to the sheath 106, as illustrated in the drawings, it is beneficially (although not necessarily) formed of an elastically deformable material or 'stretchy' material (e.g. a stretchy fabric such as cotton, polyester, nylon or rayon, or a combination of fabrics designed to provide properties such as tear-proof, waterproof, permeable, or semi-permeable). In the exemplary embodiment illustrated, the spike-receiving portion is elastically deformable (or 'stretchy) and permeable (at least one the inside) to allow water to run out and 'down' from a wet umbrella stored within the umbrella case. In this case, the sheath 106 is formed of a flexible material that may or may not also be formed of an elastically deformable or 'stretchy' material; and the sheath may or may not be formed of a material (or have a configuration) that enables it to be selectively extended, in use, upon application of a longitudinal force, to accommodate long-stick umbrellas of varying lengths. A person skilled in the art will understand that the materials used may be dependent on various design factors, and the present invention is not necessarily intended to be limited in this regard.

Referring back to FIGS. 1A, 1B and 2 of the drawings, the umbrella case further comprises a fastening strap 100 in the form of an elongate strip of flexible material, pivotally (or otherwise) coupled at one end to the outer surface of the sheath, close to its open end. The fastening strap may be formed of an elastically deformable or 'stretchy' material that allows it to be extended longitudinally upon application of a longitudinal force, or pulling, the free end. As before, the material used to form the strap 100 is a matter of design choice, as will be apparent to a person skilled in the art. However, in the illustrated example, the fastening strap 100 is formed of a stretchy, preferably tear-proof and waterproof (or quick-dry) material. The free end of the fastening strap 100 is provided with a first connecting portion 101*a* which may, for example, be one portion of any cooperative fastening means of any length, shape or size, such as hook and loop type fastening means, press studs, buttons, magnets, hook-and-eye fastening means, etc. and the present invention is not necessarily intended to be limited in this regard. A second connecting portion 101*b* of the cooperative fastening means is provided on the outer surface of the sheath 106, substantially diametrically opposite the surface at which the fastening strap 100 is affixed thereto, and can be of any length, shape of size.

Figures 6A, 6B, 6C:
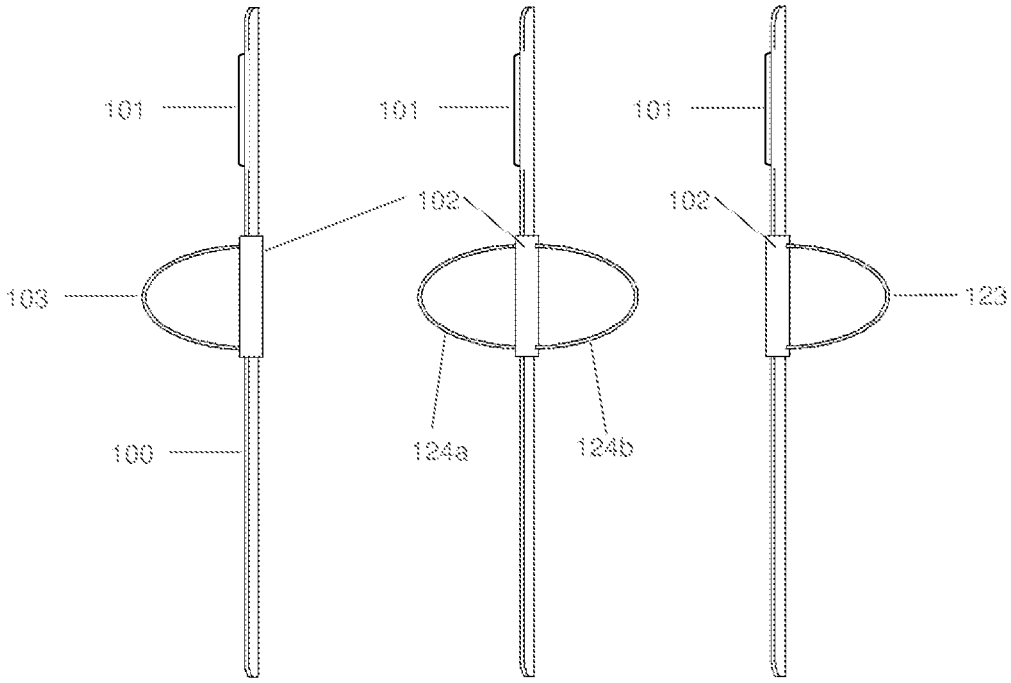
FIG. 6A is a schematic side view of a fastening strap for an umbrella case according to an exemplary embodiment of the invention, illustrating a fastening strap and retaining member having a support loop on the inner side of the retaining member.
FIG. 6B is a schematic side view of a fastening strap for an umbrella case according to another exemplary embodiment of the invention illustrating a fastening strap and retaining member having a support loop on the inner side of the retaining member and a hanging loop on its outer side.
FIG. 6C is a schematic side view of a fastening strap for an umbrella case according to yet another exemplary embodiment of the invention illustrating a fastening strap and retaining member having a hanging loop on the outer side of the retaining member.
Figure 5A:
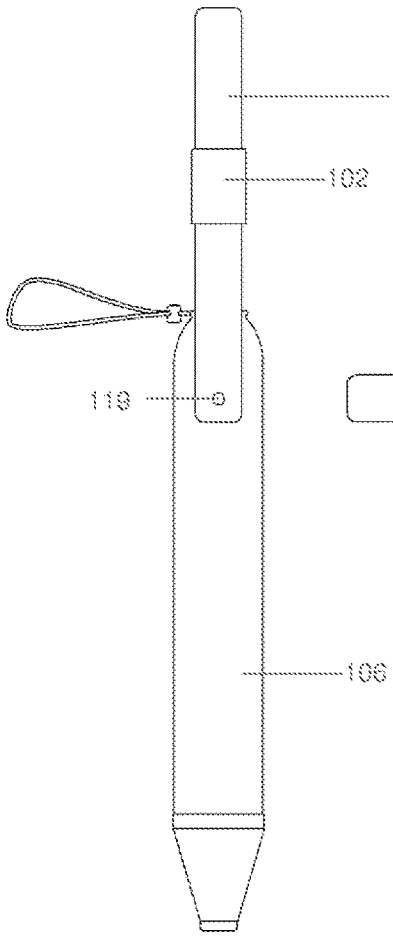
FIG. 5A is a schematic rear view of an umbrella case according to an exemplary embodiment of the invention.
Figure 5B:
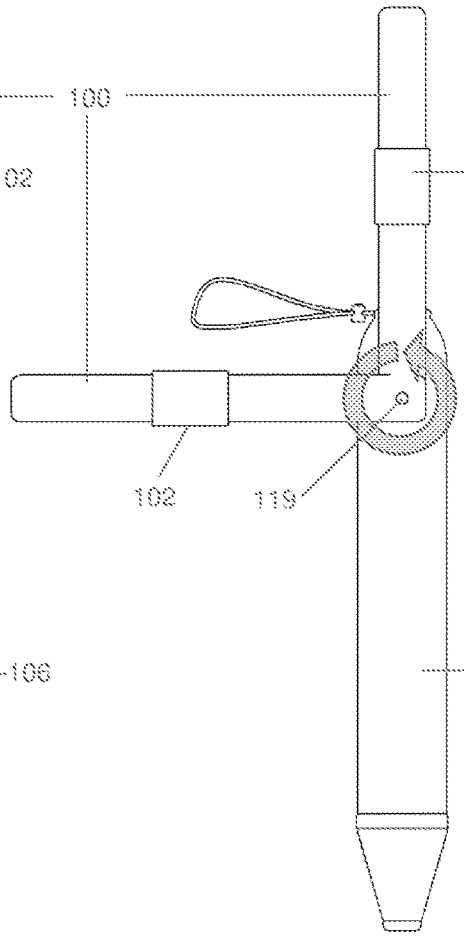
FIG. 5B is a schematic rear view of the umbrella case of FIG. 5A, wherein the fastening strap has been pivoted through substantially 90°.
Figure 5C:
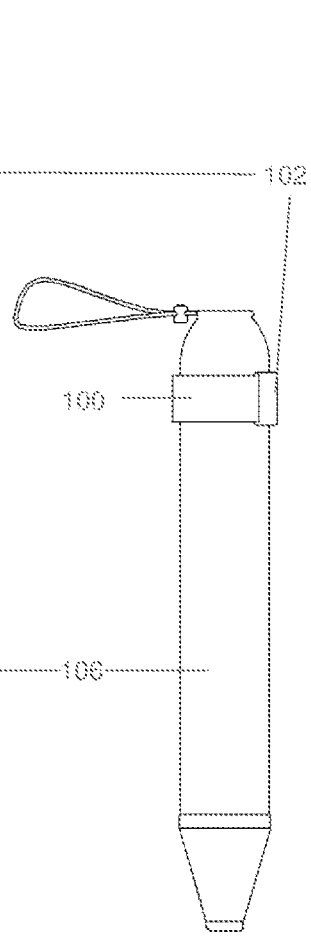
FIG. 5C is a schematic rear view of the umbrella case of FIG. 5A, wherein the fastening strap is in a stowed configuration.
Figure 5D:
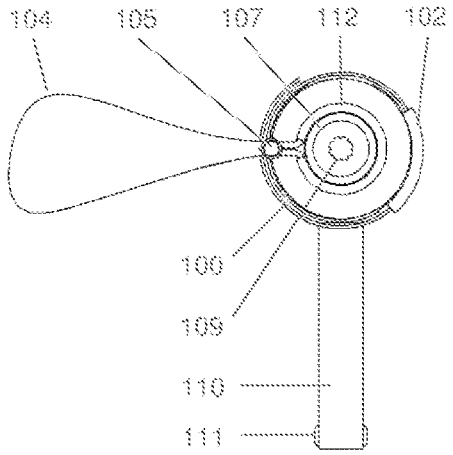
FIG. 5D is a schematic enlarged top view of the umbrella case in the configuration shown in FIG. 5C.

A retaining member 102 is provided on the fastening strap 100, and is configured, at least one an 'inner' surface thereof, i.e. the surface facing the open end of the sheath 106, to receive or support the end of an umbrella handle or a curved part of a hooked umbrella handle. In the example illustrated, and as can be seen more clearly in FIG. 3G of the drawings, the retaining member 102 is a free loop, of any suitable material, slidably mounted 122 or 'folded' around the fastening strap 100, and defines an 'outer' surface and the opposing 'inner' surface, each having a width slightly greater than that of the fastening strap 100, coupled together at the side edges by narrower regions that are slightly wider than the thickness of the fastening strap 100. The 'inner' surface (i.e. the surface facing the open end of the sheath 106) may be cushioned or otherwise shaped and configured to support or cover a straight umbrella handle or a curved portion of a hooked umbrella handle. A support loop 103 is provide across the 'inner' surface of the free loop (i.e. retaining member) 102, which may be formed of a flexible (and optionally elastically deformable) material. Indeed, and as shown in FIGS. 6A to 6C of the drawings, a single loop 103 can be provided (FIG. 6A), or two such loops 124*a* and 124*b* could be provided (FIG. 6B), one on each side of the free loop 102, the 'inner' one 124*a* being for looping under the curved portion of a hooked umbrella handle, in use, to provide additional support, and the 'outer' one 124*b* being for hanging the umbrella case on a hook or handle. Finally, and as shown in FIG. 6C, a single "hanging" loop 123 could be provided.

A carrying strap 110 is affixed to the outer surface of the sheath 106, with a first end (in this case) affixed just below the end of or pivotally over the fastening strap 100 and the other end, longitudinally spaced from the first end, and affixed close to the base of the spike-receiving portion 107. A second strap 111*a* is affixed, at one end, to the outer surface of the sheath 106, at or close to the first end of the carrying strap 110, and coupled at the other end to the carrying strap via a suitable adjuster 111 so as to provide means for selectively adjusting the size of the loop defined between the carrying strap 110 and the sheath, to take into account different user preferences, as well as the length of the umbrella being carried in the umbrella case. Any suitable flexible material, such as leather, can be used to form the carrying strap 110, as will be apparent to a person skilled in the art, and the present invention is not intended to be limited in this regard.

Referring to FIGS. 3A, 3B and 3C of the drawings, in use, a user slides the draw string adjuster 105 along the cord 104, in a direction away from the sheath 106, in order to loosen the draw string and cause or allow the open end of the sheath 106 to be released and extended to its maximum diameter, in order to receive a long stick umbrella therethrough, spike (118) first. The umbrella, in this case a straight handled umbrella 116 and 115 (rather than a hooked handle umbrella), travels through the sheath 106 by a pushing (substantially longitudinal) force exerted by the user until the ferrule of the spike 118 extends/protrudes through the hole defined by the ring 108 at the frustrum of the spike-receiving portion 107, and the base of the spike 118 or the 'open cap' of the umbrella engages with the ridged inner circumference 109 of the ring 108 (see FIGS. 3E and 3F of the drawings). At this point, no further protrusion or longitudinal movement of the umbrella through the sheath 106 is possible as the base of the spike 118 or the 'open cap' has a diameter larger than the inner diameter of the ridged hole 109, although small gaps are defined between the spike and the ridged inner circumference 109 of the ring 108, thereby providing apertures through which water can drain.

Once the base of the spike 118 or the 'open cap' of the umbrella engages with the inner ridged circumference of the ring 108, any further pushing (or longitudinal) force exerted by the user on the handle end of the umbrella (in a direction toward the spike-receiving portion 107 of the umbrella case) will cause elastic stretching 114 of the elastically deformable spike-receiving portion 107 (as shown in FIGS. 3B and 3C), to allow the entire canopy of the umbrella to be inserted into the umbrella case. In this case, the sheath 106 is formed of a substantially non-elastic material and remains of fixed length, whilst the spike-receiving portion 107 extends in length to allow the umbrella canopy to be fully received within the umbrella case with the portion of the shaft between the tips of the canopy and the handle being located at the open end of the sheath 106. Once this has been achieved, the user can stretch the fastening strap 100 over the handle 116 (diametrically across the top of the sheath 106) and secure it on the other side by means of the first and second connecting portions 101*a*, 101*b* provided on the sheath 106 and fastening strap 100 respectively. As shown in FIG. 3C of the drawings, the retaining member 102 rests over the end of the straight handle 116 to support it (and maintain the longitudinal force thereon) so as to secure the umbrella 115 and 116 in place. The draw string adjuster 105 can be moved along the cord 104 in a direction toward the sheath 106, to close the open end of the sheath 106 around the umbrella shaft, at a location between the tips of the canopy and the handle 116. In this case, the support loop 103 (FIG. 1A) is not necessarily required and can be folded out of the way or support loop 123 (FIG. 6C) can be positioned to be on the outer side of the fastening strap 100.

Referring to FIG. 3D of the drawings, an umbrella case according to an alternative exemplary embodiment of the invention is illustrated. In this case, the sheath 106 and the spike receiving portion 107 are formed (optionally integrally) of an elastically deformable material. The fastening strap 100 may or may not be elastically deformable. The operation of the umbrella case is similar in most respects to that described with reference to FIGS. 3A to 3C, except that, when the base of the spike or top cap of the umbrella 118 engages with the ridged hole 109, and further longitudinal movement of the umbrella 115 is prevented, any further longitudinal force exerted on the umbrella 115 (in a direction toward the spike-receiving portion 107) causes both the sheath 106 and the spike-receiving portion 107 to stretch or lengthen, 113 and 114 respectively, to accommodate the full length of umbrella canopy.

Referring now to FIGS. 4A to 4D of the drawings, an umbrella case of the same or similar construction as that described above with reference to FIGS. 3A to 3C, or that described with reference to FIG. 3D, is once again illustrated. In this case, the umbrella 115 has a curved or hooked handle 117. In use, the umbrella 115 is, once again, inserted into the sheath via its open end until the spike extends through the ring 108, via the ridged hole 109, and top cap of the umbrella or the base of the spike engages with therewith, such that further pushing (longitudinal) force applied by the user causes the spike-receiving portion 107 (and/or the sheath 106) to stretch 114 and/or 113 until the tips of the canopy are within the sheath 106. The fastening strap 100, which is beneficially elastically deformable, can be pivoted (or otherwise angularly deformed or deflected), toward the free end of the handle, such that it is at an angle of (say) 45° or less relative to a longitudinal axis, and then stretched over the hooked handle, and the retaining member 102 can be slid along the fastening strap 100 so as to rest on the central or 'top' part of the hooked handle (FIG. 4D). The fastening strap is secured on the other side of the sheath 106, as before. It will be appreciated that the angular offset function in relation to the fastening strap 100 (i.e. providing some means, or using a suitable material, to allow it to be stretched at an angle across the hooked handle) provides the necessary longitudinal force at the top of the hooked handle to retain the umbrella within the stretched umbrella case. In this case, the support loop 103 is located below the retaining member, where hooked handle is inserted through the support loop 103, then resting against the inner surface of the curve of the hooked handle, for additional support.

Referring to FIGS. 5A to 5D of the drawings, the fastening strap 100, in this exemplary embodiment of the invention, is pivotally coupled (119) at one end to the outer surface of the sheath (106) and the first connecting portion (101*a*— FIGS. 1A and 1B) is at the opposing end (on the surface facing the open end of the sheath 106). As described with reference to FIG. 4A, the pivotal coupling 119 enables the fastening strap 100 to be pivoted (relative to a longitudinal axis and up to 360°) in order to accommodate a long-stick umbrella having a 'hooked' handle 117. Referring back to FIGS. 5A to 5D of the drawings, when the umbrella case is not required for use, the fastening strap 100 can be pivoted through substantially 90° (relative to a longitudinal axis) such that it extends substantially orthogonally to the sheath 106 (FIG. 5B), and then wrapped around the outer circumference of the sheath 106 and secured at a connecting portion (not shown) on the outer surface of the fastening strap 100, as shown in FIGS. 5C and 5D.

Referring now to FIGS. 7A to 7D of the drawings, an alternative embodiment of an umbrella case according to the invention is illustrated schematically, which is a modified version of the umbrella case(s) described above, and wherein corresponding features shared with the previous embodiments are denoted with the same reference numerals.

In the illustrated embodiment, a grip strip 125 is provided, which may be formed of a grip/anti-slip material that is attached to the retaining member 102 as an alternative to loop 103. The grip strip 125 stops the retaining member 102 and the fastening strap 100 from slipping off an umbrella handle 116/117. The grip strip 125 is a much easier method to use/apply than the loop 103. The retaining member 102 may be permanently attached midway/centre length of the fastening strap 100 (excluding the attachment part to housing 128) since the retaining member 102 will always be equidistant on either side of umbrella handle 116/117 to the base of such handle.

Unless the material used for the sheath 106 and spike receiving portion 107 is like rubber or latex that maintain their waterproof properties/qualities when stretched, the waterproof or semi-permeable properties of the sheath 106 and spike-receiving portion 107 materials may reduce upon stretching due to fibres realigning/separating. In order to alleviate this issue, the sheath 106 and spike-receiving portion 107 may be surrounded by an affixed housing 128. The housing 128 may be formed of a waterproof or semi-permeable material that may be in any flexible to rigid form (e.g., fabric to solid tubing). When a long stick umbrella is inserted, the sheath 106 and spike-receiving portion 107 may protrude out of the housing 128. The fastening strap 100, second connecting portion 101*b*, carrying strap 110 and second strap 111*a* instead of being affixed to the outer surface of the sheath 106 are now affixed to the outer surface of the housing 128 similarly.

An upper skirt 126 is attached to the top end of the housing 128 and may be formed of a waterproof or semi-permeable material which can be opened and closed using a draw string 104 with respective adjuster 105. The upper skirt 126 may also help to keep/lock the umbrella 115 in the sheath 106 and spike-receiving portion 107.

A lower skirt 127 is attached to the bottom end of the housing 128 and may be formed of a waterproof or semi-permeable material which can be opened and closed using a draw string 104 with respective adjuster 105. The lower skirt 127 may also help to keep/lock foldable umbrellas from falling too deep into the sheath 106 and spike-receiving portion 107 due to gravity and weight of the foldable umbrella stretching the sheath 106 and spike-receiving portion 107 more than needed/necessary.

In some cases, the housing 128 could be made quite flexible, which would enable the draw string portions to be formed integrally with the body of the housing. However, the more rigid the housing 128 the more difficult it may become to open and close the ends of the housing 128 using draw strings 104 if integrated as part of the top and bottom ends of the housing 128. Instead, upper and lower skirts, 126 and 127 respectively, may be incorporated accordingly to alleviate this issue and permit easy opening and closing of both ends of the housing 128, even if it is made of a substantially rigid material.

An alternative to ring 108 may include a cuff and outward folding of the material end of the spike-receiving portion 107, similar to a long shirt sleeve folded up, and stitched/secured into a ring cuff 129. The ring cuff 129 may be of adequate size to permit only the umbrella spike 118 to jut out and stop the actual umbrella 115 from falling through.

FIG. 7D illustrates schematically the cross section of FIG. 7B with an umbrella 115-118 inserted, showing the sheath 106 and the spike-receiving portion 107 internally affixed to the housing 128. FIG. 7D also shows potential extension 113 of the sheath 106 and potential extension 114 of the spike-receiving portion 107 due to umbrella 115-118 insertion.

It will be apparent to a person skilled in the art, from the foregoing description, that modifications and variations can be made to the described embodiments without departing from the scope of the invention as defined by the appended claims. For example, a shoulder guard (not shown) may be incorporated, to provide comfort when the umbrella case is carried over a user's shoulder. The shoulder guard underside may be soft, with cushion feel and with some anti-slip quality. In some embodiments, the shoulder guard could loosely grasp strap 110/111*a* and slide up and down strap 110/111*a*; and the strap 110/111*a* is preferably configured such that it does not easily slide once the shoulder guard is in use/applied when the case is carried over the shoulder.

The invention claimed is:

1. An umbrella case configured to hold an umbrella having: a rigid shaft with a handle (116, 117) at one end and a spike (118) at the other end, the umbrella case comprising an umbrella holding assembly characterized in that: a tubular sheath (106) having an open end and a conical spike-receiving portion (107) defining a spike-receiving aperture (109) at the other end, wherein the tubular sheath (106) and the conical spike-receiving portion (107) are formed of a permeable or a semi-permeable elastic material configured to allow water to drain through and to be elastically stretched upon application of a longitudinal force, when in use, thereby to increase the effective length (113, 114) of the umbrella holding assembly to accommodate the length of an umbrella (115) held therein with the spike (118) protruding through the spike-receiving aperture (109) of the conical spike-receiving portion (107).

2. An umbrella case as claimed in claim 1, wherein the spike-receiving aperture (109) is configured to allow water to drain out through it, when in use.

3. An umbrella case as claimed in claim 1, wherein said conical spike-receiving portion (107) comprises a conical portion configured to be selectively longitudinally extended upon application of a force, said conical portion comprising a base connected to, or formed integrally with, the tubular sheath (106), and a frustrum defining the spike-receiving aperture (109).

4. An umbrella case as claimed in claim 3, wherein a rigid or semi-rigid ring (108, 129) is mounted around or inside said spike-receiving aperture (109).

5. An umbrella case as claimed in claim 4, wherein the inner surface of the semi-rigid ring (108, 129) is provided with ridges (109*a*) defining the maximum diameter of the spike-receiving aperture (109), and interposing grooves or notches.

6. An umbrella case as claimed in claim 1, further comprising an adjustment means, coupled to the open end of the tubular sheath (106), and operable to selectively increase and decrease the diameter or width of said open end.

7. An umbrella case as claimed in claim 1, further comprising a waterproof housing (128) concentrically around the tubular sheath (106) and the conical spike-receiving portion (107), wherein the waterproof housing (128) has at each end an opening (126, 127) and at least one opening (126, 127) comprising an adjustment means operable to selectively increase and decrease the diameter or width of respective opening (126, 127).

8. An umbrella case as claimed in claim 7, wherein a carrying strap (110) is coupled to the waterproof housing (128).

9. An umbrella case as claimed in claim 7, further comprising a fastening strap (100) formed of an elastic material configured to be elastically stretched upon application of a pull force, in use, thereby to increase the effective length of the fastening strap (100), having a first end coupled to the waterproof housing (128), close to the opening (126) of the waterproof housing (128), and a second, free end configured to be selectively moved to a fastening position in which it is connected to the waterproof housing (128) at a diametrically opposite location to the first end.

* * * * *